US011142385B2

(12) United States Patent
Nakamichi

(10) Patent No.: US 11,142,385 B2
(45) **Date of Patent: *Oct. 12, 2021**

(54) CONTAINER

(71) Applicant: SAKAI DISPLAY PRODUCTS CORPORATION, Sakai (JP)

(72) Inventor: Kazuki Nakamichi, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 44 days.

This patent is subject to a terminal disclaimer.

(21) Appl. No.: 16/606,624

(22) PCT Filed: May 18, 2017

(86) PCT No.: PCT/JP2017/018714
§ 371 (c)(1),
(2) Date: Dec. 19, 2019

(87) PCT Pub. No.: WO2018/211667
PCT Pub. Date: Nov. 22, 2018

(65) Prior Publication Data

US 2021/0163205 A1 Jun. 3, 2021

(51) Int. Cl.
*B65D 85/48* (2006.01)
*B65D 81/113* (2006.01)
*B65D 85/30* (2006.01)

(52) U.S. Cl.
CPC ..... *B65D 81/113* (2013.01); *B65D 85/30* (2013.01)

(58) Field of Classification Search
CPC .. B65D 81/113; B65D 81/053; B65D 81/054; B65D 81/055; B65D 81/056;
(Continued)

(56) References Cited

U.S. PATENT DOCUMENTS 9,045,273 B2 * 6/2015 Guo ..... B65D 81/056
2014/0097121 A1 * 4/2014 Chen ..... B65D 85/48 206/586
2014/0262927 A1 * 9/2014 Guo ..... B65D 81/056 206/706

FOREIGN PATENT DOCUMENTS

JP S54-041862 U 3/1979
JP S61-164188 U 10/1986
(Continued)

OTHER PUBLICATIONS

International Search Report for International application No. PCT/JP2017/018714.

*Primary Examiner* — King M Chu
(74) *Attorney, Agent, or Firm* — ScienBiziP, P.C.

(57) ABSTRACT

A container (100) comprises: an accommodation member (10) that includes a base surface member (12) that defines a base surface of an accommodation space (10*s*), and a side surface member (14) that defines a side surface of the accommodation space; and a protection member (20*a*) that has a receiving surface that abuts an object to be accommodated. The side surface member (14) includes a cutaway section (15*a*) that faces the accommodation space (10*s*). The protection member (20*a*) includes: an inner member (22*a*) provided with a receiving section that has a receiving surface (23); and an outer member (32*a*) disposed between the inner, member (22*a*) and the side surface member (14) and fitting together with the inner member (22*a*) so as to be able to slide in a direction that intersects the base surface. The inner member (22*a*) and the outer member (32*a*) of the protection member (20*a*) are disposed in the cutaway section (15*a*) so as to be independently attachable and detachable, and when the outer member (32*a*) is removed, at least part of the inner member (22*a*) can withdraw into a space where the outer member (32*a*) was present.

9 Claims, 5 Drawing Sheets

(58) Field of Classification Search
CPC ..... B65D 85/30; B65D 85/48; B65D 85/68; B65D 2585/6837; B65D 2585/058; B65D 71/04; H01L 21/67369; H01L 21/67363
USPC ..... 206/586, 454, 453, 706, 723
See application file for complete search history.

(56) References Cited

FOREIGN PATENT DOCUMENTS

| | | | |
|---|---|---|---|
| JP | S62-033147 | B2 | 7/1987 |
| JP | H05-054336 | U | 7/1993 |
| JP | 2014-009020 | A | 1/2014 |

* cited by examiner (a)

(b)

(a)

(b)

(a)

(b)

(a)

(b)

CONTAINER

TECHNICAL FIELD

The present invention relates a container, for example, a container preferably usable to transport an object accommodated therein.

BACKGROUND ART

For example, Patent Document No. 1 discloses a packaging member (i.e., container) usable to transport a display panel. The container disclosed in Patent Document No. 1 includes a corner protection member provided at a corner of a recessed portion that accommodates the display panel. The corner protection member is detachably fittable to a main body of the container and protects a corner of the display panel, which is an object to be accommodated. According to Patent Document No. 1, use of the corner protection member allows a common container main body and a common lid to be used regardless of whether a display panel having a circuit board connected therewith (hereinafter, may be referred to as a "display panel module") is to be accommodated or only a display panel is to be accommodated.

CITATION LIST

Patent Literature

Patent Document No. 1: Japanese Laid-Open Patent Publication No. 2014-9020

SUMMARY OF INVENTION

Technical Problem

However, in the case where the container described in Patent Document No. 1 is used, there are cases where during the removal of the display panel (or the display panel module) from the container, the corner of the display panel is stuck with the corner protection member, and in some cases, the display panel is broken. Or, an attempt to prevent the breakage occasionally results in a decrease in the efficiency of the work of removing the display panel. For example, there is a problem that it is difficult to automatically remove the display panel by use of a robot.

In the above, the container for the display panel is described. However, the problems that an accommodated object is broken as a result of contacting the container, and that an attempt to prevent the breakage decreases the working efficiency, during the removal of the accommodated object, are not limited to occurring in the case of a display panel.

The present invention has an object of providing a container capable of suppressing breakage of an accommodated object, and suppressing a decrease in the working efficiency, during the removal of an accommodated object.

Solution to Problem

A container according to an embodiment of the present invention includes an accommodation member including a bottom surface member defining a bottom surface of an accommodation space and a side surface member defining a side surface of the accommodation space; and at least one protection member located in the accommodation space and having at least one receiving surface to be in contact with an object to be accommodated in the accommodation space. The side surface member includes at least one cutout portion facing the accommodation space. The at least one protection member includes an inner member including a receiving portion having the at least one receiving surface and also includes an outer member located between the inner member and the side surface member and fit to the inner member so as to be slidable in a certain direction crossing the bottom surface. The inner member and the outer member included in the at least one protection member are located in the at least one cutout portion so as to be detachable in the certain direction independently. In a state where the outer member is detached, at least a part of the inner member is retractable into a space in which the outer member was present before being detached.

In an embodiment, in a state where the outer member is detached, the inner member falls toward the space in which the outer member was present before being detached.

In an embodiment, the bottom surface member defines an xy plane, the side surface member defines an xz plane and a yz plane both perpendicular to the xy plane, and the accommodation space has four corners. The at least one cutout portion includes cutout portions respectively facing at least two adjacent corners among the four corners of the accommodation space. The at least one protection member includes protection members respectively located in the cutout portions respectively facing the at least two adjacent corners. The at least one receiving surface includes two receiving surfaces respectively parallel to the xz plane and the yz plane. The outer member is fit to the inner member so as to be slidable in a z direction.

In an embodiment, the inner member includes a plurality of ribs parallel to the xz plane, and the outer member includes a plurality of grooves parallel to the xz plane.

In an embodiment, the receiving portion of the inner member has a bottom surface in contact with the bottom surface member and parallel to the xy plane. The inner member further includes a support portion formed adjacent to the receiving portion in a y direction and having a support surface parallel to the xz plane. The support surface is in contact with a surface, of the outer member, parallel to the xz plane. A bottom surface, of the support portion, facing the bottom surface member and parallel to the xy plane is not in contact with the bottom surface member.

In an embodiment, a length of the receiving portion in the z direction is longer than a length of the support portion in the z direction.

In an embodiment, the center of gravity of the inner member is present outer, to the bottom surface of the receiving portion as seen in the z direction. The center of gravity of the inner member may be shifted in an x direction, the y direction or both of the x direction and the y direction from the bottom surface of the receiving portion, as seen in the z direction.

In an embodiment, the inner member is formed of a non-expanded plastic material, and the outer member is formed of an expanded plastic material.

In an embodiment, the container further includes a protection sheet provided on each of the two receiving surfaces of the inner member. The protection sheet is formed of a non-expanded plastic material harder than the non-expanded plastic material of the inner member.

In an embodiment, the accommodation member is formed of an expanded plastic material as hard as the expanded plastic material of the outer member or an expanded plastic material softer than the expanded plastic material of the outer member.

In an embodiment, the inner member and the outer member each have a plane of symmetry parallel to the xy plane.

Advantageous Effects of Invention

According to an embodiment of the present invention provides a container capable of suppressing breakage of an accommodated object, and suppressing a decrease in the working efficiency, during the removal of an accommodated object.

DESCRIPTION OF EMBODIMENTS

Hereinafter, a container according to an embodiment of the present invention will be described with reference to the drawings. In the following, a container that accommodates a liquid crystal display panel module will be described as an example, An embodiment of the present invention is not limited to the following example. It should be noted that an embodiment of the present invention is directed to a container preferably usable to accommodate an object, like a liquid crystal display panel module, that cannot be supported by four sides but needs to be supported at corners and is formed of a material that is easily cracked or chipped away (glass or a plastic material). An embodiment of the present invention is especially directed to a container preferably usable to transport a liquid crystal display panel module.

Figure 1:
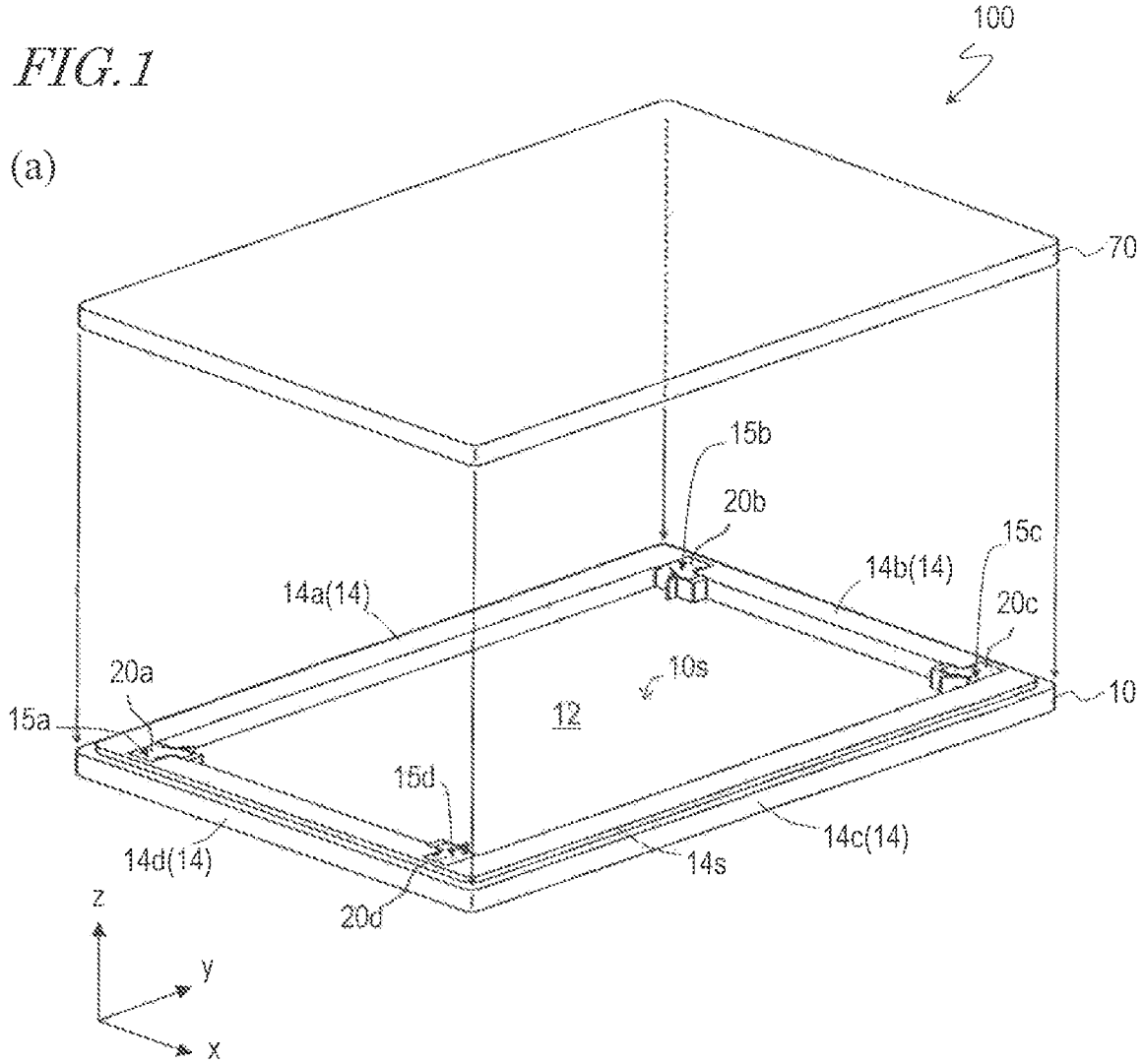
FIG. 1(*a*) is a schematic perspective view of a container 100 according to an embodiment of the present invention, and FIG. 1(*b*) is a schematic perspective view of a liquid crystal display panel module 200 to be accommodated in the container 100.
Figure 1:
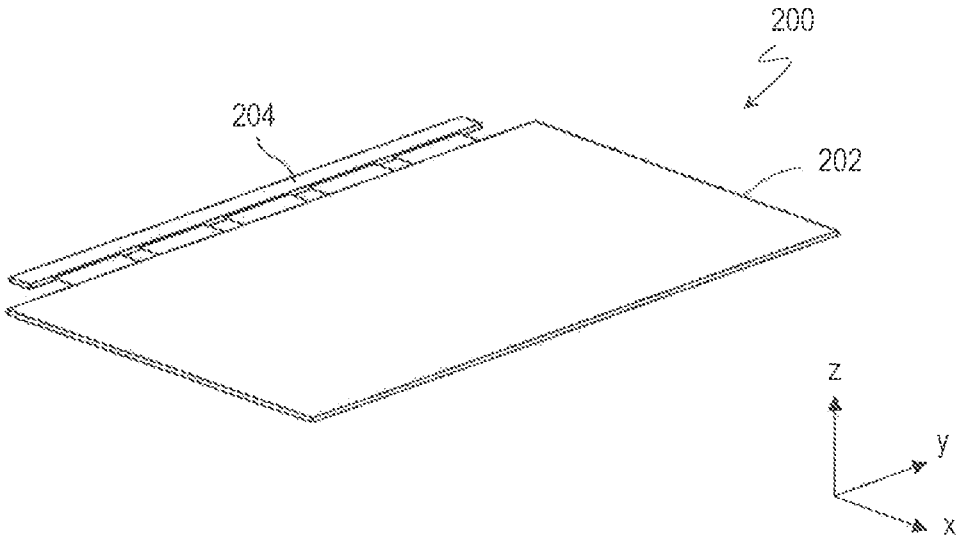

FIG. 1(*a*) is a schematic perspective view of a container 100 according to an embodiment of the present invention. FIG. 1(*b*) is a schematic perspective view of a liquid crystal display panel module (hereinafter, referred to as the "panel module") 200, which is to be accommodated in the container 100.

The container 100 includes an accommodation member 10 including a bottom surface member 12 defining a bottom surface of an accommodation space 10*s* and side surface members 14 (14*a*, 14*b*, 14*c* and 14*d*) defining side surfaces of the accommodation space IQs, and also includes protection members 20*a*, 20*b*, 20*c* and 20*d* located in the accommodation space 10*s* and having receiving surfaces to be in contact with an object to be accommodated in the accommodation space IDs. The accommodation space 10*s* has four corners. The side surface members 14 respectively include cutout portions 15*a*, 15*b*, 15*c* and 15*d* facing the four corners. The protection members 20*a*, 20*b*, 20*c* and 20*d* are respectively located in the cutout portions 15*a*, 15*b*, 15*c* and 15*d*. A lid 70 is optional and may be omitted. The bottom surface member 12 defines an xy plane, and the side surface members 14 define an kz plane and a yz plane both perpendicular to the xy plane.

In this example, four protection members 20*a*, 20*b*, 20*c* and 20*d* are respectively located at the four corners of the accommodation space 10*s*. In the case where a circuit board 204 is mounted on only one side of a liquid crystal display panel (hereinafter, referred to as the "panel") 202, like in the case of the panel module 200, only the cutout portions 15*a* and 15*b* facing at least two adjacent corners, among the four corners, may be provided and the protection members 20*a* and 20*b* may be located only in the cutout portions 15*a* and 15*b*, Instead of the cutout portions 15*c* and 15*d*, a protection member that supports, for example, a side of the panel 202 may be located. In the case where the object to be accommodated is not quadrangular (encompassing rectangular and square), for example, in the case where the object to be accommodated has a polygonal shape having five or more sides and corners such as a pentagonal shape or the like, cutout portions respectively facing the corners of the object may be provided and protection members may be respectively located in the cutout portions, for example. An angle made by two receiving surfaces of each of the protection members is appropriately changed in accordance with the shape of the corners of the object.

The panel module 200 is located in the accommodation space 10*s* of the container 100. A plurality of (e.g., 10 to 20) panel modules 200 may be located in a stacked manner. A cushioning sheet (e.g., expanded polyethylene CEPE) sheet; thickness: for example, 1 mm) may be held between the panel modules 200. It is preferred that the cushioning sheet is smaller by several millimeters to about 10 mm than an outer shape of the panel 202. Another container 100 may be stacked on the container 100 accommodating the panel module(s) 200. It is preferred that a bottom surface of each of the side surface members 14 of the container 100 has a stepped portion (not shown) engageable with a stepped portion 14*s* provided at a top surface of the corresponding side surface member 14. It is preferred that a bottom surface of the lid 70 has stepped portions (not shown) engageable with the stepped portions 14*s* provided at the top surfaces of the side surface members 14.

Figure 2:
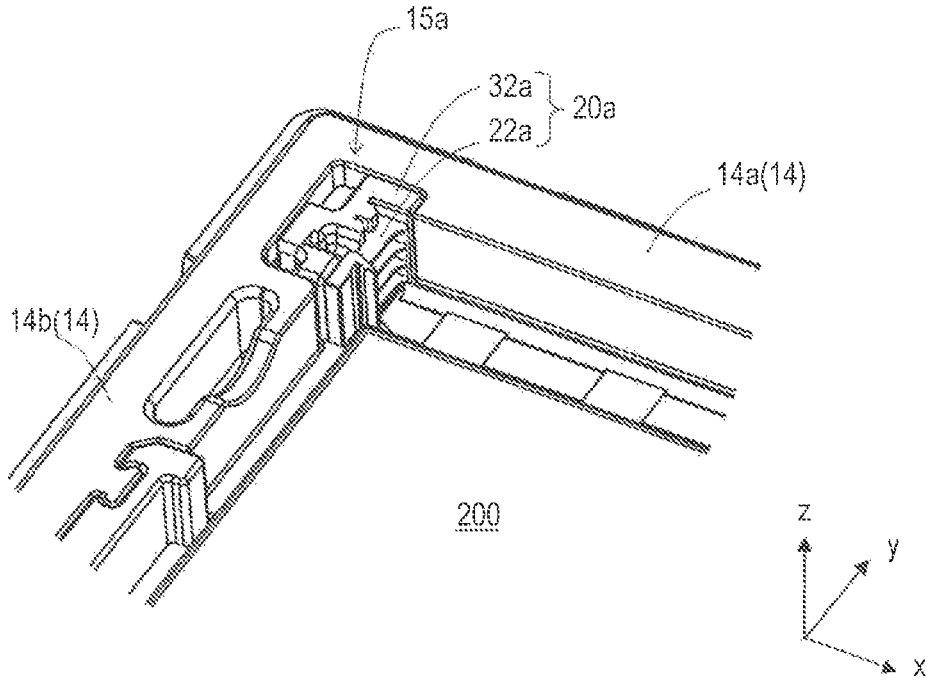
FIG. 2(*a*) is a schematic perspective view showing a state where a protection member 20*a* is attached to a cutout portion 15*a* of an accommodation member 10 of the container 100, and FIG. 2(*b*) is a schematic perspective view showing a state where an outer member 32*a* of the protection member 20*a* is detached.
Figure 2:
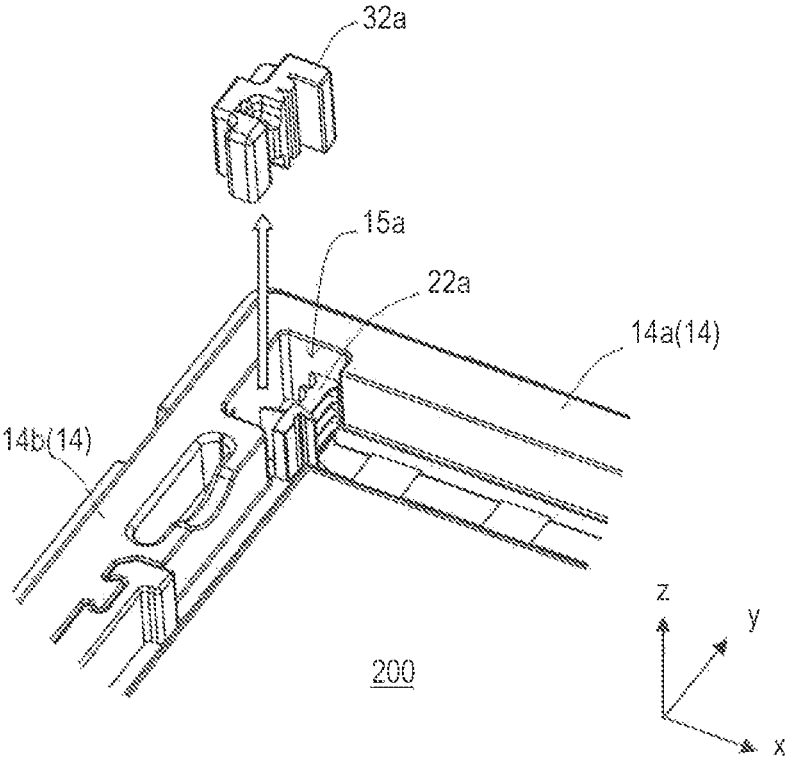

Now, FIG. 2 will be referred to. FIG. 2(*a*) is a schematic perspective view showing a state where the protection member 20*a* is attached to the cutout portion 15*a* of the accommodation member 10 of the container 100. FIG. 2(*b*) is a schematic perspective view showing a state where an outer member 32*a* of the protection member 20*a* is detached. The protection members 20*b*, 20*c* and 20*d* each have an equivalent structure as that of the protection member 20*a*. Thus, the protection member 20*a* will be described as an example, hereinafter.

The protection member 20*a* includes an inner member 22*a* having receiving surfaces to be in contact with the panel module 200, and the outer member 32*a* located between the inner member 22*a* and the side surface members 14 (14*a* and 14*b*). The outer member 32*a* is fit to the inner member 22*a* so as to be slidable in a z direction. The inner member 22*a* and the outer member 32*a* are located in the cutout portion 15*a* while being detachable in the z direction independently.

The protection member 20*a* has a generally parallelepiped shape as a whole. The outer member 32*a* has side surfaces parallel to the xz plane and the yz plane and a top surface and a bottom surface both parallel to the xy plane (side surface 33*sb* and side surface 34*s* shown in FIG. 3(*a*)). The outer member 32*a* is located in the cutout portion 15*a* such that the side surfaces of the outer member 32*a* that are parallel to the xz plane and the yz plane are in contact with side surfaces of the cutout portion 15*a* that are parallel to the xz plane and the yz plane.

The inner member 22*a* is fittable to the outer member 32*a*. While the inner member 22*a* is located in the cutout portion 15*a*, two receiving surfaces of the inner member 22*a* are parallel to the xz plane and the yz plane and are in contact with a corner of the panel module 200 (panel 202), and the inner member 22*a* holds the panel module 200 together with the inner members of the other three protection members 20*b*, 20*c* and 20*d* so as not to move the panel module 200 in the xy plane. As shown in FIG. 2(*b*), when the outer member 32*a* is slid in the z direction to be detached from the cutout portion 15*a*, a space into which at least a part of the inner member 22*a* may be retracted is formed in an area of the cutout portion 15*a* where the outer member 32*a* was present before being detached.

Figure 3:
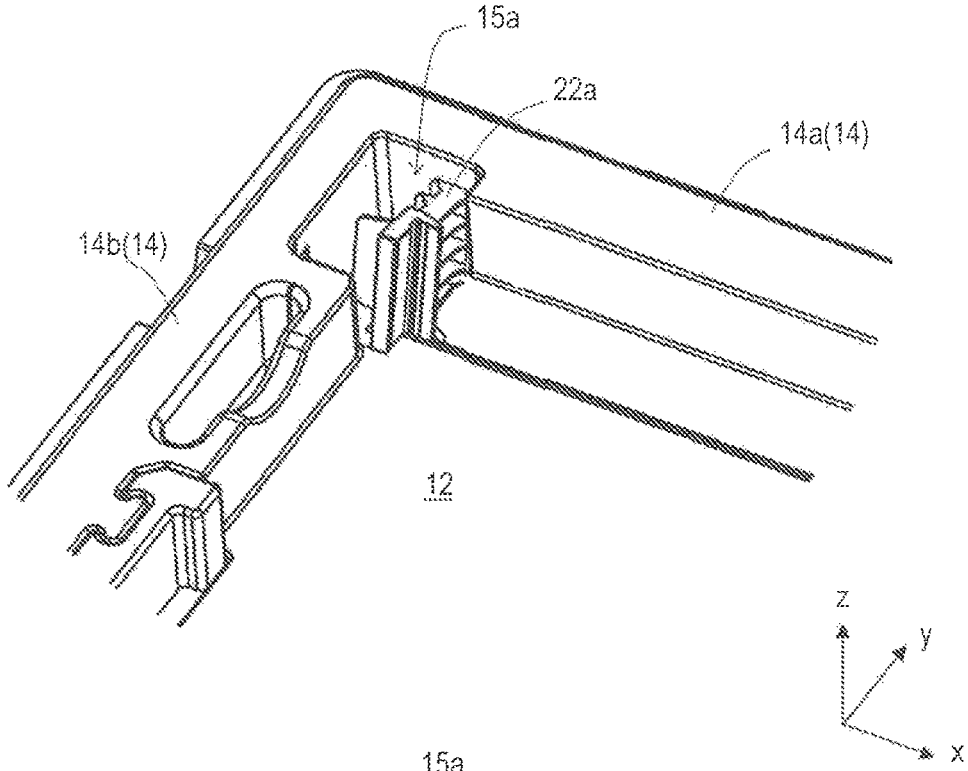
FIG. 3(*a*) is a schematic perspective view showing a state where an inner member 22*a* of the protection member 20*a* falls in a y direction, and FIG. 3(*b*) is a schematic perspective view showing a state where the inner member 22*a* of the protection member 20*a* fails in a −x direction.
Figure 3:
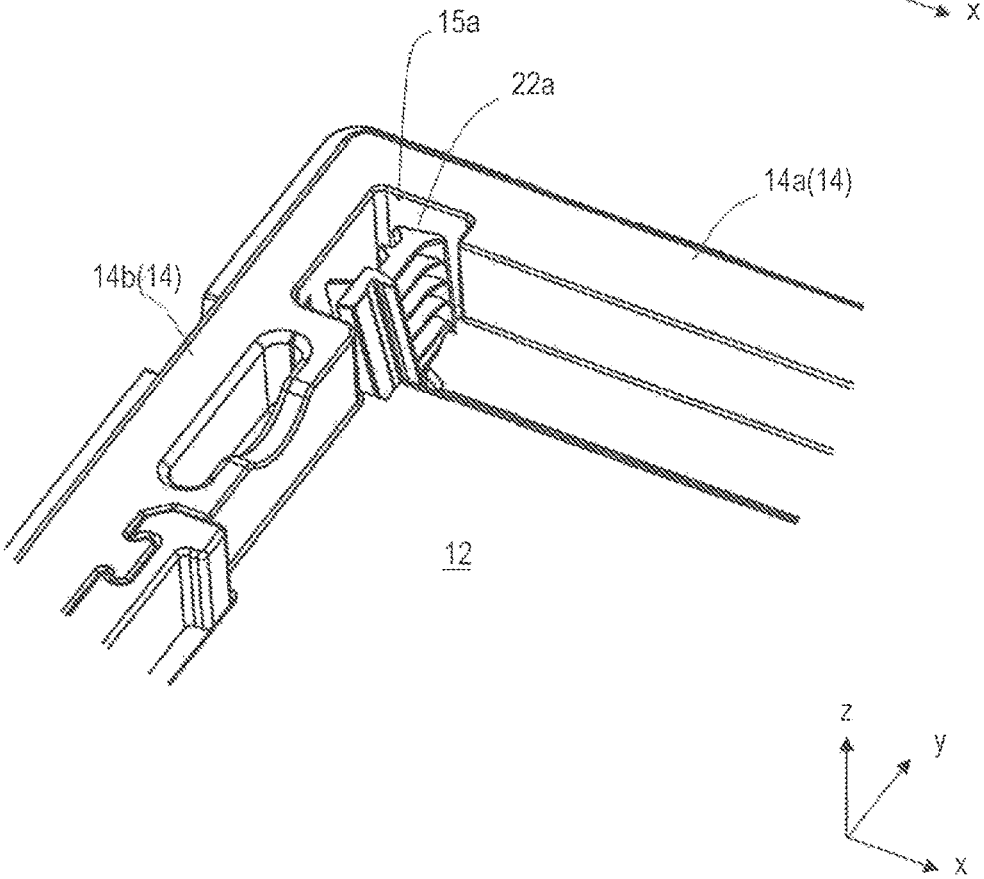

In this example, as a structure that allows at least a part of the inner member 22*a* to be retracted into the space where the outer member 32*a* was present before being detached, a structure that when the outer member 32*a* is detached, allows the inner member 22*a* to fall toward the space where the outer member 32*a* was present before being detached will be described. The inner member 22*a* in this example cannot stand itself in a state where the two receiving surfaces are parallel to the z direction, and fall in a direction away from the panel module 200. Therefore, the inner member 22*a* fall toward the space where the outer member 32*a* was present before being detached. The inner member 22*a* may be set to fall in a y direction as shown in FIG. 3(*a*) or may be set to fall in a −x direction as shown in FIG. 3(*b*). Needless to say, the inner member 22*a* may be set to fall either in the −x direction or in the y direction.

In FIG. 3(*a*) and FIG. 3(*b*), a recessed portion or the like formed in the side surface member 14 (14*b*) is provided in order to decrease the weight of the side surface member 14 and/or the amount of the material of the side surface member 14. Such a technique is well known in the field of plastic processing, and thus will not be described herein.

When the inner member 22*a* falls in a direction away from the panel module 200 as described above, a sufficiently large gap is formed between the panel module 200 and the inner member 22*a*. Therefore, during the removal of the panel module 200 from the accommodation space 10*s*, the corner of the panel module 200 (panel 202) is suppressed from contacting the inner member 22*a*. In addition, there is no component that supports the inner member 22*a*. Therefore, even if the inner member 22*a* does not fall in a direction away from the panel module 200 for some reason and as a result, the panel module 200 contacts the inner member 22*a*, no force that may break the panel module 200 is applied to the panel, module 200. With such a structure, during the removal of the panel module 200, the problem does not occur that the panel module 200 is broken as a result of contacting the inner member 22*a*, or that the working efficiency is decreased by an attempt to prevent the breakage. For example, a robot may be used to automatically remove the panel module 200 from the container 100.

In a state where the protection member 20*a* is attached to the cutout portion 15*a*, it is preferred that the clearance between the above-described side surfaces of the outer member 32*a* and the above-described side surfaces of the cutout portion 15*a* is small. For example, the side surfaces of the outer member 32*a* and the side surfaces of the cutout portion 15*a* may be in contact with each other as long as the outer member 32*a* is easily detached from the cutout portion 15*a* while being nipped by a hand of a user. The clearance between one of the receiving surfaces of the inner member 22*a* and the panel module 200 is, for example, about 1 mm to about 3 mm in the case where, for example, the panel module 200 is of a 60-inch type. The clearances may be set to be small as described above, so that the panel module 200 is suppressed from moving in a plane parallel to the xy plane while being transported. In addition, the protection member 20*a* includes the inner member 22*a* and the outer member 32*a* separable from each other. Therefore, even if, for example, a large acceleration is caused to the panel module 200 in the xy plane by sudden braking or the like during the transportation and as a result, a large impact is applied to the receiving surfaces, the protection member 20*a* exhibits a larger effect of absorbing the impact than in the case of being of a single member.

Figure 4:
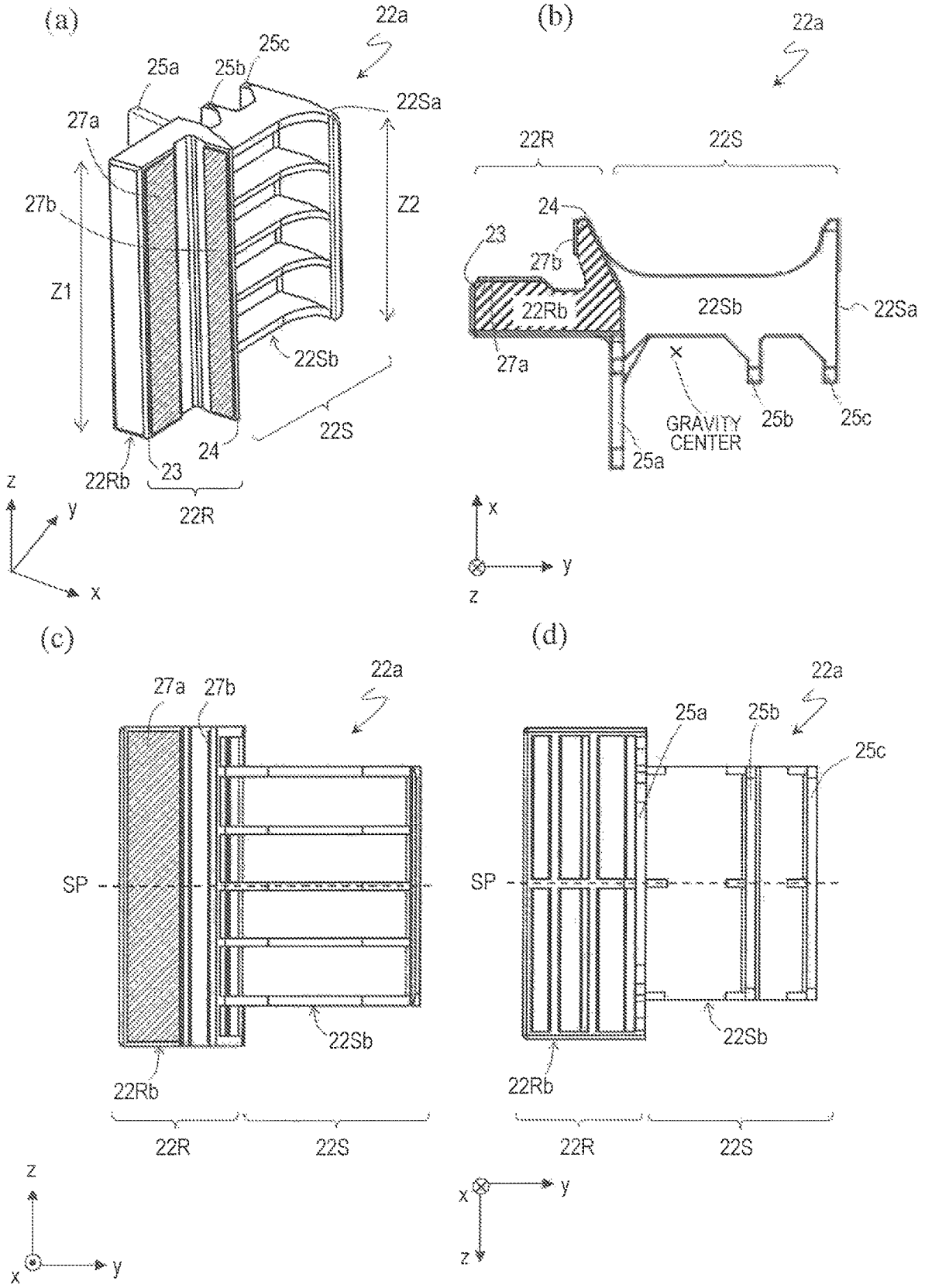
FIG. 4(*a*) is a schematic perspective view of the inner member 22*a*, FIG. 4(*b*) is a schematic plan view of the inner member 22*a* as seen in a z direction, FIG. 4(*c*) is a schematic plan view of the inner member 22*a* as seen the −x direction, and FIG. 4(*d*) is a schematic plan view of the inner member 22*a* as seen an x direction.
Figure 5:
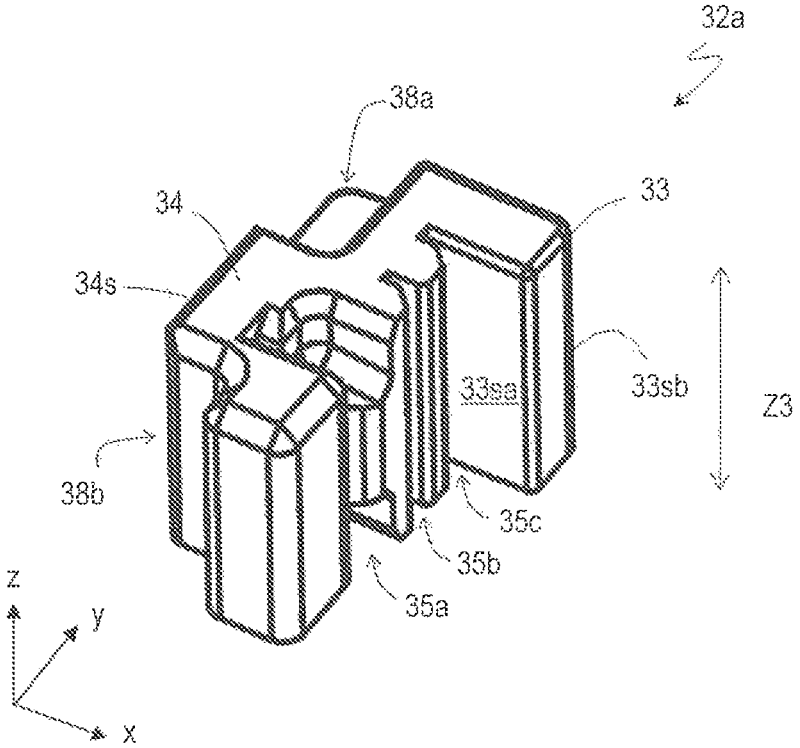
FIG. 5(*a*) is a schematic perspective view of the outer member 32*a*, and FIG. 5(*b*) is a schematic perspective view of the protection member 20*a* including the outer member 32*a* and the inner member 22*a* fit to each other.
Figure 5:
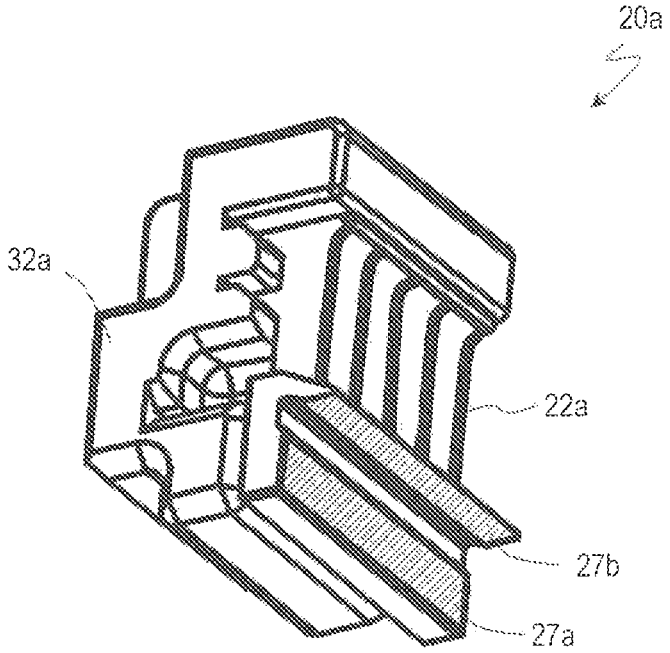

Now, with reference to FIG. 4(*a*) through FIG. 4(*d*), FIG. 5(*a*) and FIG. 5(*b*), an example of the inner member 22*a* and the outer member 32*a* will be described in detail. FIG. 4(*a*) is a schematic perspective view of the inner member 22*a*. FIG. 4(*b*) is a schematic plan view cf the inner member 22*a* as seen in the z direction. FIG. 4(*c*) is a schematic plan view of the inner member 22*a* as seen the −x direction. FIG. 4(*d*) is a schematic plan view of the inner member 22*a* as seen an x direction. FIG. 3(*a*) is a schematic perspective view of the outer member 32*a*. FIG. 5(*b*) is a schematic perspective view of the protection member 20*a* including the outer member 32*a* and the inner member 22*a* fit to each other.

As shown, in FIG. 4(*a*), the inner member 22*a* includes a receiving portion 22R having receiving surfaces 23 and 24, and a support portion 223 formed adjacent to the receiving portion 22R in the y direction and having a support surface 22Sa parallel to the xz plane. The inner member 22*a* includes a plurality of ribs 25*a*, 25*b* and 25*c* provided in the support portion 22S and parallel to the xz plane. Optional protection sheets 27*a* and 27*b* are respectively provided on the receiving surfaces 23 and 24. The protection sheets 27*a* and 27*b* may be omitted.

As shown in FIG. 5(*a*), the outer member 32*a* includes a plurality of grooves 35*a*, 35*b* and 35*c* parallel to the xz plane. The ribs 25*a*, 25*b* and 25*c* of the inner member 22*a* are respectively inserted into the grooves 35*a*, 35*b* and 35*c* of the outer member 32*a*, and as a result, the inner member 22*a* and the outer member 32*a* are fit to each other. In a state where the inner member 22*a* and the outer member 32*a* are fit to each other, the support surface 22Sa of the inner member 22*a* is in contact with a surface 33*sa*, of the outer member 32*a*, parallel to the plane (see FIG. 5(*b*)).

A bottom surface 22Rb, of the receiving portion 22R, parallel to the xy plane is in contact with the bottom surface member 12. By contrast, a bottom surface 22Sb, of the support portion 22S, facing the bottom surface member 12 and parallel to the xy plane is not in contact with the bottom surface member 12. Namely, length Z1 of the receiving portion 22R in the z direction is longer than length 22 of the support portion 22S in the s direction, and only the bottom surface 22Rb of the receiving portion 22R is in contact with the bottom surface member 12.

As shewn in FIG. 4(*b*), the inner member 22*a* is structured such that the center of gravity thereof is present outer to the bottom surface 22Rb of the receiving portion 22R as seen in the z direction. The center of gravity of the inner member 22*a* may be shifted from the bottom surface 22Rb of the receiving portion 22R in the direction, in the y direction, or both of the −x direction and the y direction as seen in the x direction. Since the center of gravity of the inner member 22*a* is shifted from the bottom surface 22Rb of the receiving portion 22R as described above, the inner member 22*b* cannot stand itself on the bottom surface member 12 and falls in a direction in which the center of gravity thereof is shifted.

The center of gravity of the inner member 22*a* may be adjusted by, for example, the shape of the support portion 22S. For example, the rib 25*a* may be protruded to be inserted deep into the groove 35*a* of the outer member 32*a*, so that the center of gravity of the inner member 22*a* is shifted in the direction.

The structure to cause the inner member 22*a* to fall in the −x direction or in the y direction may be modified in any of various manners. For example, a protrusion may be provided on the bottom surface 22Rb of the receiving portion 22R. Even with the structure in which the protrusion is provided on the bottom surface 22Rb, the receiving surfaces 23 and 24 may be located to be parallel to the z direction in a state where the inner member 22*a* is fit to the outer member 32*a*.

As shown in FIG. 5(*a*), the outer member 32*a* has the side surface 33*sb* parallel to the xz plane and the side surface 34*s* parallel to the yz plane. The outer member 32*a* is located, such that the side surface 33*sb* and the side surface 34*s* are respectively in contact with the side surfaces of the cutout portion 15*a* of the side surface members 14 that are parallel to the xz plane and the yz plane, and such that the bottom surface of the outer member 32*a* parallel to the xy plane is in contact with the bottom surface member 12. A portion 33 of the outer member 32*a* is located between the inner member 22*a* and the side surface member 14*a*, and a portion 34 of the outer member 32*a* is located between the inner member 22*a* and the side surface member 14*b* (see, for example, FIG. 2(*a*)). The outer member 32*a* supports the receiving surfaces 23 and 24 of the inner member 22*a* such that the receiving surfaces 23 and 24 are parallel to the z direction, and may decrease the impact applied from the inner member 22*a* to the side surface members 14. The outer member 32*a* does not need to have the bottom surface parallel to the xy plane. A reason for this is that the outer member 32*a* may be located such that the side surface 33*sb* and the side surface 34 are parallel to the z direction by contacting the side surfaces of the cutout portion 15*a* of the side surface members 14 that are parallel to the xz plane and the yz plane.

The outer member 32*a* further includes recessed portions 38*a* and 38*b*. The recessed portions 38*a* and 38*b* are provided such that in a state where the outer member 32*a* is located in the cutout portion 15*a*, hollows are formed between the outer member 32*a* and the side surface members 14. For detaching the outer member 32*a* located in the cutout portion 15*a*, fingertips may be inserted into the hollows formed between the outer member 32*a* and the side surface members 14, Thus, the outer member 32*a* may be nipped easily with the fingers.

As represented by the dashed line in, for example, FIG. 4(*c*) and FIG. 4(*d*), the inner member 22*a* has a plane of symmetry SP parallel to the xy plane. Similarly, the outer member 32*a* has a plane of symmetry parallel to the xy plane. With such a structure, common inner members 22*a* and common outer members 32*a* may be used to form the four protection members 20*a*, 20*b*, 20*c* and 20*d*.

Now, preferred materials for each of the components of the container 100 will be described. The materials described below are preferred examples of materials for the container 100 transporting the panel module 200, and the preferred materials are not limited to those described below.

The accommodation member 10 (bottom surface member 12 and side surface members 14), the outer member 32*a* and the inner members 22*a* may all be formed of a plastic material. A plastic material preferably usable for these components is any of various known plastic materials (thermoplastic resins). Examples of the usable plastic material include polyolefins such as polyethylene, polypropylene and the like, polystyrenes, and mixtures (blends) thereof. These plastic materials in an expanded form are also usable.

For the accommodation member 10, a material having a large effect of absorbing the impact during the transportation is preferred. The accommodation member 10 is preferably formed of an expanded plastic material. For the inner member 22*a*, which directly receives a force from the panel module 200 (panel 202), a material harder than the material of the outer member 32*a* and the material of the accommodation member 10 is preferred. The inner member 22*a* is preferably formed of a non-expanded plastic material. The protection sheets 27*a* and 27*b* are preferably formed of a non-expanded plastic material harder than the material of the inner member 22*a*. The outer member 32*a*, which is located between the accommodation member 10 and the inner member 22*a*, is preferably formed of a material having a hardness between the hardness of the material of the accommodation member 10 and the hardness of the material of the inner member 22*a*, or a material as hard as the material of the accommodation member 10, for example, an expanded plastic material.

For example, the inner member 22*a* is formed of, preferably, non-expanded polyethylene, and more preferably, high density polyethylene from the point of view of the hardness. The protection sheets 27*a* and 27*b* are in direct contact with, for example, a glass substrate of the panel module 200 (panel 202) and therefore, is preferably formed of polycarbonate, which is highly abrasion resistant.

The outer member 32*a* is preferably formed of, for example, expanded polyethylene (EPE) or expanded polypropylene (EPP). Alternatively, an expanded form of a mixture (blend) or polyethylene or polypropylene and polystyrene may be used for the outer member 32*a*. The expansion ratio of these expanded plastic materials is, for example, 10 to 20 times. For example, an expanded form of a mixture (blend) of polyethylene and polystyrene expanded at a ratio of 10 times is preferably usable for the outer member 32*a*.

The accommodation member 10 is preferably formed of expanded polyethylene (EPE), expanded polypropylene (EPP) or expanded polystyrene (EPS, also referred to as "styrofoam"). Among these materials, expanded polystyrene (EPS) is most preferable. It should be noted that in order to transport the panel module 200 more safely, it is especially preferred to use expanded polystyrene expanded at a ratio lower than that of commonly used expanded polystyrene (expansion ratio: about 70 times), for example, expanded polystyrene expanded at a ratio of about 20 times to about 50 times.

The above-described materials have been selected based on results of an impact test. For the impact test, a state where 20 liquid crystal display panel modules (60 inches) are accommodated in the container 100 produced with various materials was simulated. With the above-described materials, the liquid crystal display panel modules may be transported very safely. Namely, the liquid crystal display panel modules may be suppressed from being broken during the transportation. The 60-inch liquid crystal display panel modules used for the test had a size of about 1300 mm×about 800 mm. The container 100 had an outer shape of about 1500 mm ×about 1600 mm to about 900 mm ×about 1000 mm and a height of about 120 mm to about 150 mm. In order to increase the strength, the outer shape of the container 100 may be increased. In order to increase the transportation efficiency and decrease the cost, the outer shape of the container 100 may be decreased. The material of each of the components may be selected from the above-listed materials, and the size of each of the components may be optimized, in accordance with the use.

In the above, the structure of the container 100 according to an embodiment of the present invention is described in the case where the object to be accommodated is a panel module, which is very easily broken. The structure in which the protection member 20*a* includes the inner member 22*a* and the outer member 32*a* and at least a part of the inner member 22*a* is retracted into a space formed by the detachment of the outer member 32*a* is applicable regardless of the shape or the material of the object to be accommodated. Such a structure suppresses breakage of the accommodated object, and also suppresses a decrease in the working efficiency, during the removal of the object.

Namely, a container according to another embodiment of the present invention may include an accommodation member including a bottom surface member defining a bottom surface of an accommodation space and a side surface member defining a side surface of the accommodation space; and at least one protection member located in the accommodation space and having at least one receiving surface to be in contact with an object to be accommodated in the accommodation space. The side surface member may include at least one cutout portion facing the accommodation space. The at least one protection member may include an inner member including a receiving portion having the at least one receiving surface and also include an outer member located between the inner member and the side surface member and fit to the inner member so as to be slidable m a certain direction crossing the bottom surface. The inner member and the outer member included in the at least one protection member may be located in the at least one cutout portion so as to be detachable in the certain direction independently. In a state where the outer member is detached, at least a part of the inner member may be retractable into a space in which the outer member was present before being detached.

As a structure that allows at least a part of the inner member to be retracted into the space where the cuter member was present before being detached, a structure that in a state where the outer member is detached, allows the inner member to fall toward the space where the outer member was present before being detached may be adopted. Such a structure does not require a special work or operation to retract at least a part of the inner member (e.g., movement of the inner member in a plane parallel to the bottom surface). This allows a robot to be used to automatically remove the accommodated object from the container more easily.

INDUSTRIAL APPLICABILITY

An embodiment of the present invention is directed to a container preferably usable to, for example, transport an object accommodated therein.

REFERENCE SIGNS LIST

10 accommodation member
10*s* accommodation space
12 bottom surface member
14, 14*a*, 14*b*, 14*c*, 14*d* side surface, member
14*s* stepped portion
15*a*, 15*b*, 15*c*, 15*d* cutout portion
20*a*, 20*b*, 20*c*, 20*d* protection member
22R receiving portion
22Eb bottom surface
22S support portion
22Sa support surface
22Sb bottom surface
22*a* inner member
23, 24 receiving surface
25*a*, 25*b*, 25*c* rib
32*a* outer member
35*a*, 35*b* groove
70 lid
100 container
200 liquid crystal display panel module
202 liquid crystal display panel
204 circuit board

The invention claimed is:

1. A container, comprising:

an accommodation member including a bottom surface member defining a bottom surface of an accommodation space and a side surface member defining a side surface of the accommodation space; and at least one protection member located in the accommodation space and having at least one receiving surface to be in contact with an object to be accommodated in the accommodation space, wherein the side surface member includes at least one cutout portion facing the accommodation space, wherein the at least one protection member includes an inner member including a receiving portion having the at least one receiving surface and also includes an outer member located between the inner member and the side surface member and fit to the inner member so as to be slidable in a certain direction crossing the bottom surface, wherein the inner member and the outer member included in the at least one protection member are located in the at least one cutout portion so as to be detachable in the certain direction independently, wherein in a state where the outer member is detached, at least a part of the inner member is retractable into a space in which the outer member was present before being detached, wherein the bottom surface member defines an xy plane, the side surface member defines an xz plane and a yz plane both perpendicular to the xy plane, and the accommodation space has four corners, wherein the at least one cutout portion includes cutout portions respectively facing at least two adjacent corners among the four corners of the accommodation space, wherein the at least one protection member includes protection members respectively located in the cutout portions respectively facing the at least two adjacent corners, wherein the at least one receiving surface includes two receiving surfaces respectively parallel to the xz plane and the yz plane, wherein the outer member is fit to the inner member so as to be slidable in a z direction, wherein the receiving portion of the inner member has a bottom surface in contact with the bottom surface member and parallel to the xy plane, wherein the inner member further includes a support portion formed adjacent to the receiving portion in a y direction and having a support surface parallel to the xz plane, wherein the support surface is in contact with a surface, of the outer member, parallel to the xz plane, and wherein a bottom surface, of the support portion, facing the bottom surface member and parallel to the xy plane is not in contact with the bottom surface member.

2. The container of claim 1, wherein in a state where the outer member is detached, the inner member falls toward the space in which the outer member was present before being detached.

3. The container of claim 1, wherein the inner member includes a plurality of ribs parallel to the xz plane, and the outer member includes a plurality of grooves parallel to the xz plane.

4. The container of claim 1, wherein a length of the receiving portion in the z direction is longer than a length of the support portion in the z direction.

5. The container of claim 1, wherein the center of gravity of the inner member is present outer to the bottom surface of the receiving portion as seen in the z direction.

6. The container of claim 1, wherein the inner member is formed of a non-expanded plastic material, and the outer member is formed of an expanded plastic material.

7. The container of claim 6, further comprising a protection sheet provided on each of the two receiving surfaces of the inner member, wherein the protection sheet is formed of a non-expanded plastic material harder than the non-expanded plastic material of the inner member.

8. The container of claim 6, wherein the accommodation member is formed of an expanded plastic material as hard as the expanded plastic material of the outer member or an expanded plastic material softer than the expanded plastic material of the outer member.

9. The container of claim 1, wherein the inner member and the outer member each have a plane of symmetry parallel to the xy plane.

* * * * *